US011224552B2

(12) United States Patent
Fife et al.

(10) Patent No.: US 11,224,552 B2
(45) Date of Patent: Jan. 18, 2022

(54) SUCTION APPARATUS

(71) Applicant: Typenex Medical, LLC, Chicago, IL (US)

(72) Inventors: John M. Fife, Chicago, IL (US); Karl G. Fife, Chicago, IL (US); Alexander Sullivan, Chicago, IL (US); Bradley A. Palmer, Chicago, IL (US)

(73) Assignee: Typenex Medical, LLC, Chicago, IL (US)

( * ) Notice: Subject to any disclaimer, the term of this patent is extended or adjusted under 35 U.S.C. 154(b) by 6 days.

(21) Appl. No.: 16/479,552

(22) PCT Filed: Jan. 19, 2018

(86) PCT No.: PCT/US2018/014515
§ 371 (c)(1),
(2) Date: Jul. 19, 2019

(87) PCT Pub. No.: WO2018/136791
PCT Pub. Date: Jul. 26, 2018

(65) Prior Publication Data

US 2019/0358109 A1 Nov. 28, 2019

Related U.S. Application Data

(60) Provisional application No. 62/448,955, filed on Jan. 20, 2017.

(51) Int. Cl.

| | |
|---|---|
| ***A61G 13/10*** | (2006.01) |
| ***A47G 27/02*** | (2006.01) |
| ***A47L 7/00*** | (2006.01) |
| ***A61G 10/00*** | (2006.01) |

(52) U.S. Cl.
CPC ..... *A61G 13/102* (2013.01); *A47G 27/0206* (2013.01); *A47L 7/0004* (2013.01); *A61G 10/00* (2013.01)

(58) Field of Classification Search
None
See application file for complete search history.

(56) References Cited

U.S. PATENT DOCUMENTS

| | | | |
|---|---|---|---|
| 3,165,773 | A | 1/1965 | Palpacelli |
| 3,277,009 | A | 10/1966 | Freifeld et al. |
| 3,394,702 | A | 7/1968 | Heimlich et al. |
| 3,520,300 | A | 7/1970 | Flower, Jr. |
| 3,605,171 | A | 9/1971 | Candor et al. |
| 3,719,736 | A | 3/1973 | Woodruff |
| 4,533,352 | A | 8/1985 | Van Beek et al. |
| 4,635,913 | A | 1/1987 | Rothman |
| 4,679,590 | A | 7/1987 | Hergenroeder |

(Continued)

FOREIGN PATENT DOCUMENTS

| | | |
|---|---|---|
| CN | 105073156 | 11/2015 |
| CN | 209377448 | 9/2019 |

(Continued)

*Primary Examiner* — Alexander S Thomas
(74) *Attorney, Agent, or Firm* — McDonnell Boehnen Hulbert & Berghoff LLP

(57) ABSTRACT

An apparatus may include a first layer that includes a plurality of inlets and a surface feature; a second layer, where the surface feature opposes the second layer; an outlet, and a pattern defined on at least one of the first layer and the second layer, where the pattern defines a suction path from each inlet of the plurality of inlets to the outlet.

17 Claims, 8 Drawing Sheets

(56) References Cited

U.S. PATENT DOCUMENTS

| | | | |
|---|---|---|---|
| 4,729,404 | A | 3/1988 | Hergenroeder |
| 5,032,184 | A | 7/1991 | Ogilvie et al. |
| 5,176,667 | A | 1/1993 | Debring |
| 5,272,191 | A | 12/1993 | Ibrahim et al. |
| 5,349,965 | A | 9/1994 | McCarver |
| 5,393,528 | A | 2/1995 | Staab |
| 5,655,258 | A | 8/1997 | Heintz |
| 5,720,078 | A | 2/1998 | Heintz |
| 5,827,246 | A | 10/1998 | Bowen |
| 6,102,073 | A | 8/2000 | Williams |
| 6,136,098 | A | 10/2000 | Tribastone |
| 6,235,009 | B1 | 5/2001 | Skow |
| 6,249,932 | B1 | 6/2001 | Chu et al. |
| 6,290,685 | B1 | 9/2001 | Insley et al. |
| 6,532,618 | B2 | 3/2003 | Koch |
| 6,568,419 | B1 | 5/2003 | Robinson |
| 6,637,453 | B2 | 10/2003 | Robinson |
| 6,938,639 | B1 | 9/2005 | Robinson |
| 7,124,772 | B1 | 10/2006 | Browning |
| 7,131,965 | B1 | 11/2006 | Thornbury et al. |
| 7,290,558 | B2 | 11/2007 | DeChard et al. |
| 7,291,376 | B1 | 11/2007 | Siegel et al. |
| 7,727,466 | B2 | 6/2010 | Meathrel et al. |
| 7,901,389 | B2 | 3/2011 | Mombrinie |
| 8,434,491 | B2 | 5/2013 | Born |
| 8,603,514 | B2 | 12/2013 | Yang et al. |
| 8,663,782 | B1 | 3/2014 | Siegel et al. |
| 8,839,812 | B2 | 9/2014 | Tanhehco et al. |
| 8,905,986 | B2 | 12/2014 | Jaeb et al. |
| 8,939,951 | B1 | 1/2015 | Getsay |
| 2007/0191800 | A1 | 8/2007 | Bowen |
| 2007/0191801 | A1 | 8/2007 | Bowen |
| 2008/0103462 | A1 | 5/2008 | Wenzel et al. |
| 2008/0119802 | A1 | 5/2008 | Riesinger |
| 2008/0306457 | A1 | 12/2008 | Ryan |
| 2014/0196805 | A1 | 7/2014 | Tanhehco et al. |
| 2014/0224349 | A1 | 8/2014 | Ducree et al. |
| 2014/0230185 | A1 | 8/2014 | Burea et al. |
| 2015/0297434 | A1 | 10/2015 | Hergenroeder |
| 2016/0007815 | A1 | 1/2016 | Esposito |

FOREIGN PATENT DOCUMENTS

| | | |
|---|---|---|
| GB | 2466667 | 7/2010 |
| KR | 20130109418 | 10/2013 |
| KR | 20140065898 | 5/2014 |
| WO | WO 97/24972 | 7/1997 |
| WO | WO 2007/030103 | 3/2007 |
| WO | WO 2014/113125 | 7/2014 |

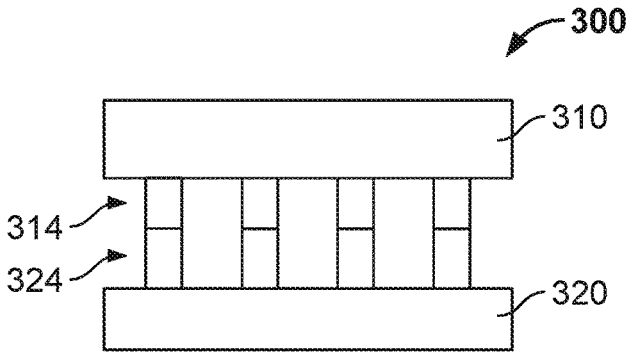
FIG. 3A
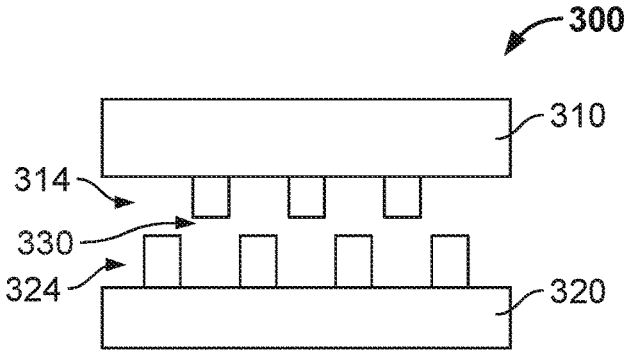
FIG. 3B
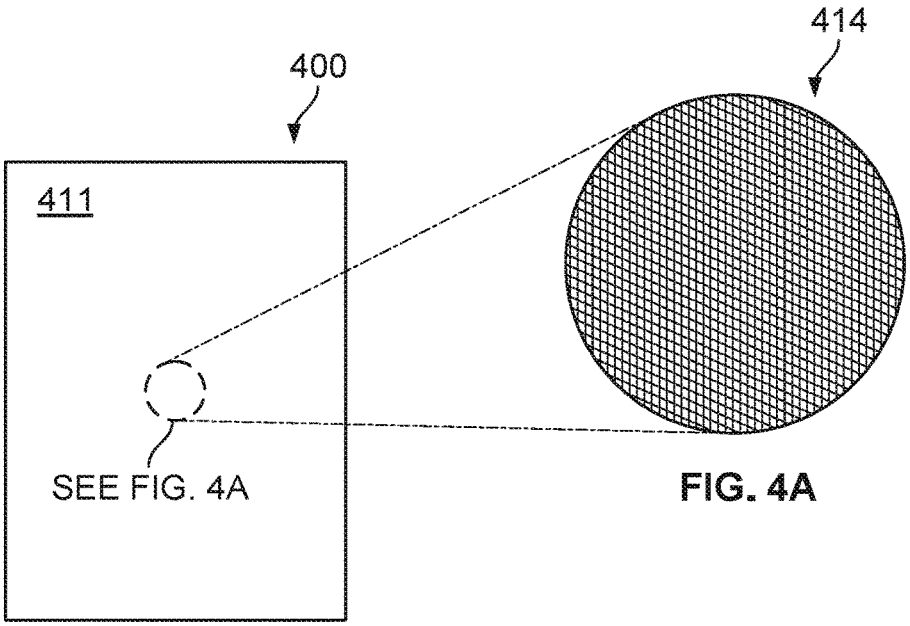
FIG. 4A
FIG. 4

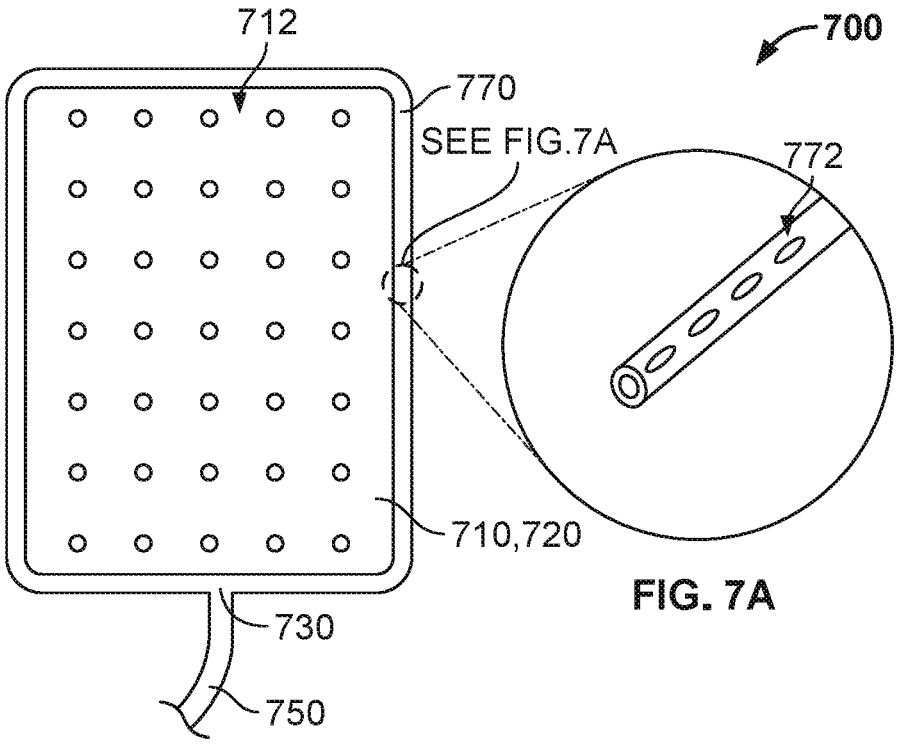
FIG. 7A
FIG. 7
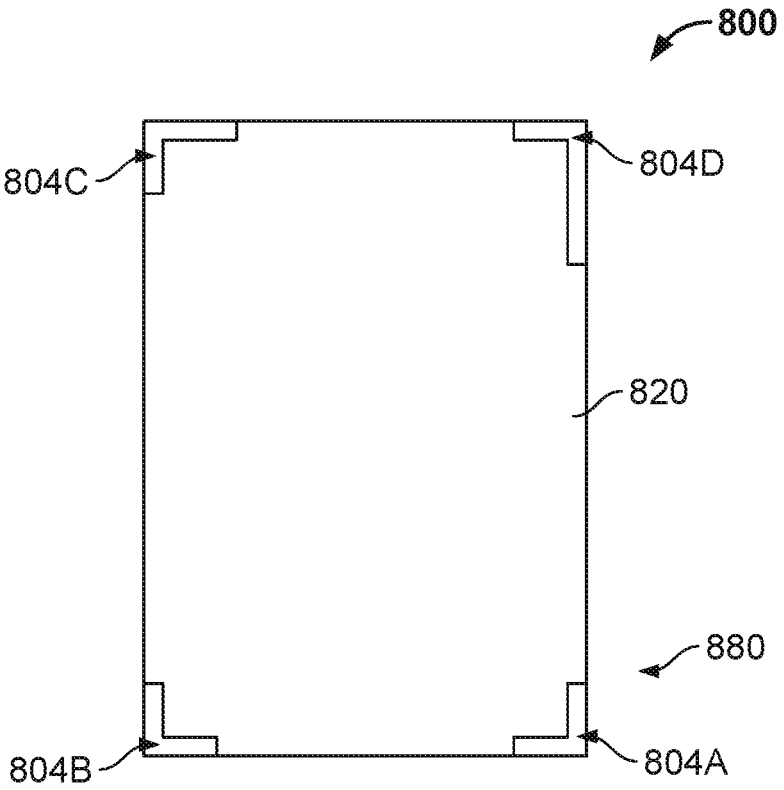
FIG. 8

SUCTION APPARATUS

CROSS-REFERENCE TO RELATED APPLICATIONS

The present application is a National Phase application of, and claims the benefit of, International (PCT) Application No. PCT/US2018/014515, filed Jan. 19, 2018, which claims priority to U.S. Provisional Application No. 62/448,955, filed Jan. 20, 2017, each of which is hereby incorporated by reference.

BACKGROUND

During medical procedures, fluid may come into contact with a floor of an operating room, Excess fluid may be removed from the floor during or after the medical procedure.

SUMMARY

In one aspect, an apparatus is disclosed. Example apparatus may include a first layer including a plurality of inlets and a surface feature; a second layer, where the surface feature opposes the second layer; an outlet, and a pattern defined on at least one of the first layer and the second layer, where the pattern defines a suction path from each inlet of the plurality of inlets to the outlet.

In another aspect, an apparatus is disclosed, where the pattern comprises a grid, and where the grid defines the suction path from each inlet of the plurality of inlets to the outlet.

In another aspect, an apparatus is disclosed, where the suction paths from each inlet of the plurality of inlets to the outlet have substantially equal lengths.

In another aspect, an apparatus is disclosed, where the pattern comprises a perimeter disposed around the plurality of inlets, where the perimeter has one or more openings, and where the perimeter and one or more openings define the suction path from each inlet of the plurality of inlets to the outlet.

In another aspect, an apparatus is disclosed, where the surface feature is molded on the first layer.

In another aspect, an apparatus is disclosed, where the second layer includes a second surface feature, and where the second surface feature contacts the first surface feature.

In another aspect, an apparatus is disclosed, where the second surface feature is molded on the second layer.

In another aspect, an apparatus is disclosed, where the pattern is defined on the first layer and the second layer by sealing the first layer and the second layer.

In another aspect, an apparatus is disclosed, where the pattern is defined on the first layer and the second layer by pressing the pattern on the first layer and the second layer.

In another aspect, an apparatus is disclosed, where at least one of the first layer and the second layer includes a surfactant that reduces surface tension of fluid.

In another aspect, an apparatus is disclosed that further includes a cover layer disposed over the first layer, where the cover layer is configured to distribute fluid to two or more inlets of the plurality of inlets.

In another aspect, an apparatus is disclosed, where at least one inlet of the plurality of inlets includes a perforation in the first surface.

In another aspect, an apparatus is disclosed, where the plurality of inlets has an area that is greater than an area of the outlet.

In another aspect, an apparatus is disclosed that further includes a tube coupled to the outlet, where the tube is disposed around the plurality of inlets, and where the tube comprises a plurality of perforations through a surface of the tube.

In another aspect, an apparatus is disclosed, where the outlet is configured to be coupled to a suction source for applying suction between the first and second layers.

In another aspect, an apparatus is disclosed that further includes a plurality of dissolvable barriers disposed over the plurality of inlets.

In another aspect, an apparatus is disclosed, where at least one dissolvable barrier of the plurality of dissolvable barriers includes a gas-impervious film.

In another aspect, an apparatus is disclosed, where each dissolvable barrier of the plurality of dissolvable barriers is configured to dissolve when contacted by liquid.

In another aspect, an apparatus is disclosed that further includes a dissolvable barrier layer disposed over the plurality of inlets and the first layer, where the dissolvable barrier layer includes a plurality of portions, where each portion of the plurality of portions is disposed over a respective inlet of the plurality of inlets.

In another aspect, an apparatus is disclosed. Example apparatus may include a first layer including a plurality of inlets; a second layer, where the second layer opposes the first layer; a perimeter outlet disposed between the first and second layer, where the outlet is configured to be coupled to a suction source configured to apply suction between the first layer and the second layer; and a third layer disposed between the first layer and the second layer, where the third layer defines a suction path from each inlet of the plurality of inlets to the outlet.

In another aspect, an apparatus is disclosed. Example apparatus may include a first layer including a plurality of inlets; a second layer; where the second layer opposes the first layer; one or more outlets; and a plurality of dissolvable barriers disposed over the plurality of inlets.

In another aspect, an apparatus is disclosed. Example apparatus may include a first layer including a plurality of inlets; a second layer; where the second layer opposes the first layer; one or more outlets; and a dissolvable barrier layer disposed over the plurality of inlets and the first layer.

In another aspect, an apparatus is disclosed. Example apparatus may include a first layer including a plurality of inlets and a surface feature; a second layer, where the surface feature opposes the second layer; two or more outlets; and a pattern defined on at least one of the first layer and the second layer, where the pattern defines a suction path from each inlet of the plurality of inlets to at least one outlet of the two or more outlets.

In another aspect, an apparatus is disclosed that further includes a first side and a second side, where the second side opposes the first side, and where each outlet of the two or more outlets is disposed on the first side of the apparatus.

In another aspect, an apparatus is disclosed that further includes a first side and a second side, where the second side opposes the first side, where a first outlet of the two or more outlets is disposed on the first side of the apparatus, and where a second outlet of the two or more outlets is disposed on the second side of the apparatus.

In another aspect, a method is disclosed. Example methods may include positioning an apparatus in a location of a medical procedure, where the apparatus includes a first layer including a plurality of inlets and a surface feature, a second layer, where the surface feature opposes the second layer; an outlet, and a pattern defined on at least one of the first layer and the second layer, where the pattern defines a suction path from each inlet of the plurality of inlets to the outlet;

coupling the outlet of the apparatus to a suction source configured to apply suction between the first layer and the second layer; and operating the suction source, such that fluid that contacts the apparatus flows through at least one inlet of the plurality of inlets and flows along the respective suction path for the at least one inlet to the outlet.

In another aspect, a method is disclosed. Example methods may include positioning an apparatus in a location of a medical procedure, where the apparatus includes a first layer comprising a plurality of inlets and a surface feature, a second layer, wherein the surface feature opposes the second layer, two or more outlets, and a pattern defined on at least one of the first layer and the second layer, where the pattern defines a suction path from each inlet of the plurality of inlets to at least one outlet of the two or more outlets; coupling the one or more outlets of the apparatus to one or more suction sources configured to apply suction between the first layer and the second layer, and operating the one or more suction sources, such that fluid that contacts the apparatus flows through at least one inlet of the plurality of inlets and flows along the respective suction path for the at least one inlet to the at least one outlet.

BRIEF DESCRIPTION OF THE DRAWINGS

The accompanying drawings, which are included to provide a further understanding of the disclosure, are incorporated in and constitute a part of this specification, illustrate embodiments of the disclosure, and together with the detailed description serve to explain the principles of the invention. No attempt is made to show structural details of the invention in more detail than may be necessary for a fundamental understanding of the invention and various ways in which it may be practiced.

FIG. 3A shows aspects of an apparatus, according to an example embodiment.

FIG. 3B shows aspects of an apparatus, according to an example embodiment.

FIG. 4 shows a layer, according to an example embodiment.

FIG. 4A shows aspects of the layer depicted in FIG. 4, according to an example embodiment.

FIG. 7 shows aspects of an apparatus, according to an example embodiment.

FIG. 7A shows aspects of a tube depicted in FIG. 7, according to an example embodiment.

FIG. 8 shows aspects of an apparatus, according to an example embodiment.

DETAILED DESCRIPTION

I. Introduction

Figure 1:
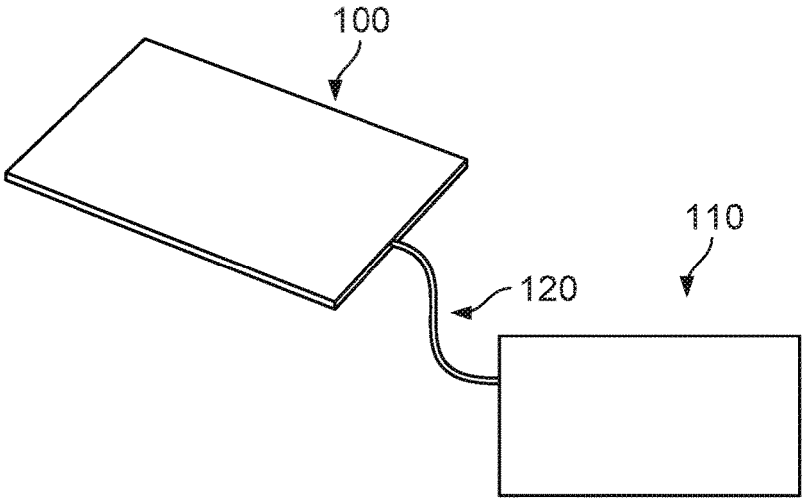
FIG. 1 shows an apparatus coupled to a suction source, according to an example embodiment.

Disclosed herein are apparatus and methods for removing fluid associated with a medical procedure. For example, during a medical procedure in a room (e.g., operating room in a hospital, clinic, or the like) excess fluid may contact the floor of the room. Exemplary apparatus may be configured to be coupled to one or more suction sources that pull fluid through the apparatus. Beneficially, embodiments described herein may improve flow of fluid through the apparatus. For example, embodiments described herein may reduce closing of layers of the apparatus, which may improve flow of fluid through the apparatus. As another example, embodiments described herein may improve distribution of suction across the apparatus, which may improve flow of fluid through the apparatus.

II. Example Apparatus

FIGS. 1-13 show apparatus and aspects of apparatus, according to example embodiments. FIGS. 1-13 are provided for purposes of illustration only and components of apparatus depicted in the Figures are not to scale. Further, components of apparatus depicted in the Figures with the same or similar reference numerals in different Figures may take the same or similar form and operate in the same or similar manner unless otherwise noted.

FIG. 1 shows an apparatus 100 coupled to a suction source 110, according to an example embodiment. The apparatus 100 may take the form of a planar structure having multiple layers. In some embodiments, the apparatus 100 may be referred to as a mat. The apparatus 100 may be coupled to the suction source 110 by a conduit 120.

The suction source 110 may be configured to apply suction to the apparatus 100. In some embodiments, the suction source 110 may be configured to pull a vacuum in the apparatus 100. By applying suction to the apparatus 100, the suction source 110 may pull fluid that contacts the apparatus 100 through the apparatus 100 and to the suction source 110. In some embodiments, the suction source 110 may pull air, water, and/or other fluids associated with medical procedures through the apparatus 100. Further, in some embodiments, the suction source 110 may be any suitable hospital wall suction device.

The conduit 120 may be configured to convey suction from the suction source 110 to the apparatus 100. Further, the conduit 120 may be configured to convey fluid from the apparatus 100 to the suction source 110. In some embodiments, the conduit 120 may include a tube or piping.

Figure 2:
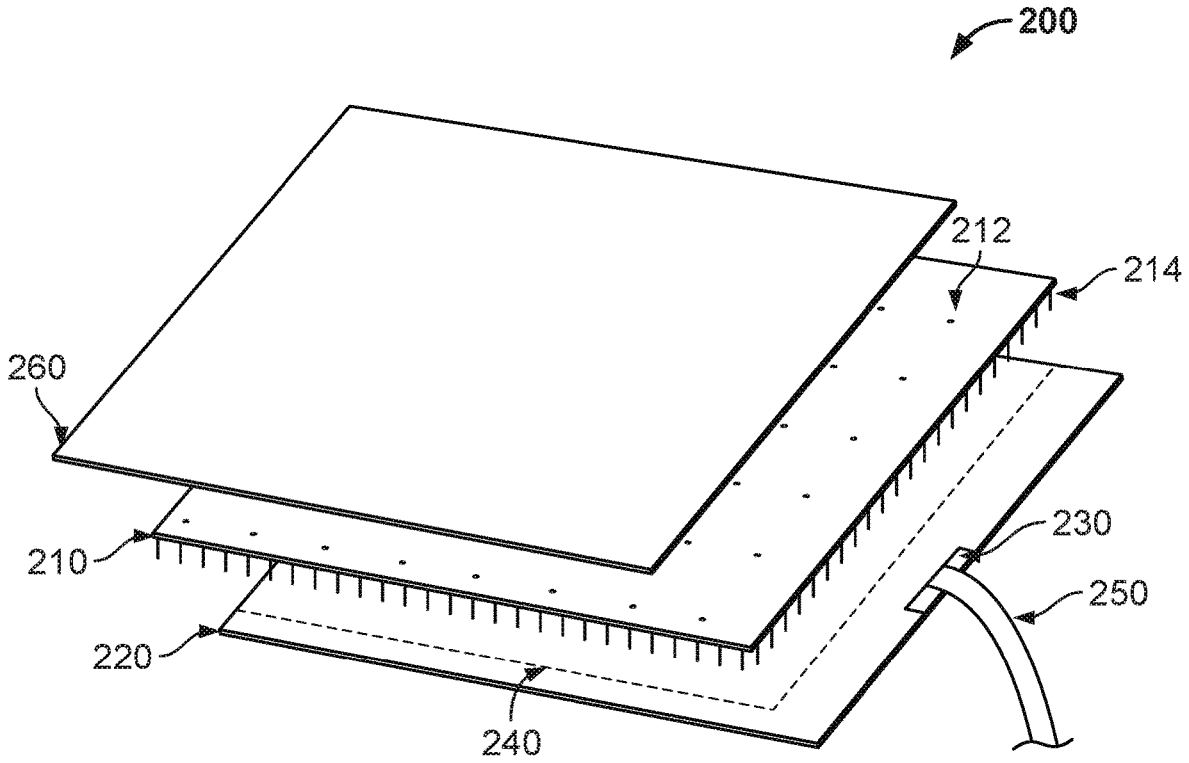
FIG. 2 shows an exploded view of an apparatus, according to an example embodiment.

FIG. 2 shows an exploded view of an apparatus 200, according to an example embodiment. The apparatus 100 may take the form of or be similar in form to the apparatus 200. The apparatus 200 may include a top (first) layer 210, a bottom (second) layer 220, an outlet 230, and a pattern 240. The top layer 210 and the bottom layer 220 may be sealed (joined) together. In some embodiments, the top layer 210 and the bottom layer 220 may be sealed together by sealing one or more edges of the top layer 210 to corresponding edge(s) of the bottom layer 220. Further, the outlet 230 may be disposed between the top layer 210 and the bottom layer 220. Alternatively, in some embodiments, the outlet 230 may be disposed on the bottom layer 220 or disposed on the top layer 210. In some embodiments, the outlet 230 may include a port. The outlet 230 may be coupled to a tube 250. The tube 250 in turn may be coupled to a suction source (not shown), such as the suction source 110.

The top layer 210 may include a plurality of inlets 212 and a surface feature 214. The plurality of inlets 212 may be through the top layer 210. In some embodiments, at least one inlet of the plurality of inlets 212 may be a perforation through the top layer 210. Fluid that contacts the top layer 210 may flow through some or all inlets of the plurality of inlets 212. In some embodiments, the plurality of inlets 212 may cover some or all of the top layer 210. Moreover, in some embodiments, the plurality of inlets 212 may include between 20 to 40 inlets, such as 20 inlets, 30 inlets, 35 inlets, and 40 inlets. Further, in some embodiments, at least one inlet of the plurality of inlets 212 may have a size between 0.75 to 1.5 millimeters, such as 0.75 millimeters, 1.09 millimeters, and 1.5 millimeters. Further still, in some embodiments, a size of at least one inlet of the plurality of inlets 212 may depend on the number of inlets in the plurality of inlets 212. However, in some embodiments, the plurality of inlets 212 may include more than 40 inlets or less than 20 inlets. Further, in some embodiments, at least one inlet may have a size greater than 1.5 millimeters or less than 0.75 millimeters.

Moreover, in some embodiments, the plurality of inlets 212 may have an area greater than an area of the outlet 230. For example, the plurality of inlets 212 may have an area (e.g., sum of the cross-sectional area of each inlet of the plurality of inlets 212) that is between 5% to 10% greater than an area (e.g., cross-sectional area) of the outlet 230, such as 5% greater than the area of the outlet 230 or 10% greater than the area of the outlet 230. Flow of fluid through the apparatus 200 may be improved (e.g., greater volumetric flow rate) when the area of the plurality of inlets 212 is greater than the area of the outlet 230.

The surface feature 214 may oppose the bottom layer 220. Further, the surface feature 214 may be configured to maintain space (void) between the top layer 210 and the bottom layer 220. When the suction source applies suction to the apparatus 200, by maintaining space between the top layer 210 and the bottom layer 220, the surface feature 214 may reduce the top layer 210 and the bottom layer 220 from closing on each other, which may improve flow of fluid through the apparatus 200.

In the apparatus 200, fluid might not flow through the shortest path to the suction source. Instead, in the apparatus 200, fluid may flow through a least-resistance path. It may be desirable to improve distribution of suction across the apparatus 200, which may improve flow of fluid through the apparatus 200. In some embodiments, the pattern 240 may improve distribution of suction across the apparatus 200. In the illustrated example, the pattern 240 is defined on the bottom layer 220. The pattern 240 may define a suction path from each inlet of the plurality of inlets 212 to the outlet 230. Via the pattern 240, the suction source may apply the substantially same amount of suction to each inlet of the plurality of inlets 212. The term "substantially same," as used in this disclosure, refers to exactly the same or one or more deviations from exactly the same that do not significantly change flow of fluid through apparatus described herein (e.g., less than or equal to a 25% change in volumetric flow rate of fluid).

The apparatus may further include a cover layer 260. The cover layer 260 may be disposed over the top layer 210. In some embodiments, the cover layer 260 may be attached to the top layer 210 by lamination, bonding, and/or adhesive. The cover layer 260 may be configured to distribute (e.g., wick) fluid to two or more inlets of the plurality of inlets 212. In some embodiments, the cover layer 260 may absorb and/or hold fluid across some or all of the top layer 210. Further, in some embodiments, the cover layer 260 may reduce pooling of fluid in one portion of the top layer 210. The cover layer 260 may include various materials and have various sizes. In some embodiments, the cover layer 260 may include melt blown polypropylene. Moreover, in some embodiments, the cover layer 260 may have a density between 200 to 300 grams per square meter ("GSM"), such as 200 GSM or 300 GSM, It may be desirable to reduce the thicknesses of the cover layer 260, which may improve flow of fluid through the apparatus 200 and/or reduce a saturated weight of the apparatus 200.

Further, in some embodiments, the top layer 210 and the bottom layer 220 may include the same materials and have the same sizes. However, in other embodiments, the top layer 210 and the bottom layer 220 may include different materials and/or have different sizes.

Although in the example described above the top layer 210 includes the surface feature 214, in other embodiments, the bottom layer 220 may include the surface feature 214. In such embodiments, the surface feature 214 may oppose the top layer 210. Moreover, in some embodiments, the top layer 210 and the bottom layer 220 may each include a surface feature.

Further, although in the example described above the pattern 240 is defined on the bottom layer 220, in other embodiments, the pattern 240 may be defined on the top layer 210. Moreover, in some embodiments, the pattern 240 may be defined on the top layer 210 and the bottom layer 220.

FIG. 3A shows aspects of an apparatus 300, according to an example embodiment. The apparatus 300 may include a top layer 310 and a bottom layer 320. The top layer 310 may include a surface feature 314 and the bottom layer 320 may include a second surface feature 324. The apparatus 300 may include other components as well, including a plurality of inlets and a pattern as described above with respect to apparatus 200.

In some embodiments, the surface feature 314 may contact the second surface feature 324. When a suction source applies suction to the apparatus 300, the surface feature 314 and the second surface feature 324 may reduce the top layer 310 and the bottom layer 320 closing on each other. In some embodiments, the surface feature 314 and the second surface feature 324 may reduce the top layer 310 and the bottom layer 320 closing on each other more than the surface feature 214 may reduce the top layer 210 and the bottom layer 220 closing on each other.

In some embodiments, the surface feature 314 may be molded on the top layer 310. Further, in some embodiments, the second surface feature 324 may be molded on the bottom layer 320. Moreover, in some embodiments, the surface feature 314 and the second surface feature 324 may have the same size and shape. However, in other embodiments, the surface feature 314 and the second surface feature 324 may have different shapes and/or sizes.

In some embodiments, the surface feature 314 may be offset from the second surface feature 324. FIG. 3B shows aspects of the apparatus 300, according to an example embodiment. As shown in FIG. 3B, the surface feature 314 may be offset from the second surface feature 324. With this arrangement, one or more gaps between the surface feature 314 and the second surface feature 324 may define a channel 330. When a suction source applies suction to the apparatus 300, fluid may flow through the channel 330.

FIG. 4 shows a layer 400, according to an example embodiment. The top layers, bottom layers, and intermediate layers described herein may take the form of or be similar in form to the layer 400. The layer 400 may include various materials and have various sizes. In some embodiments, the layer 400 may include a polyethylene film. Further, in some embodiments, the layer 400 may have a thickness of around 0.0016 inches. Other materials and thicknesses of the layer 400 are possible as well. Moreover, in some embodiments, the layer 400 may include a surfactant to reduce surface tension of fluid. Flow of fluid through apparatus described herein may be improved when the layer 400 includes a surfactant. In some embodiments, the surfactant may include a coating, such as a stearate coating.

The layer 400 may include a surface feature 414 on at least one surface 411 of the layer 400. The surface feature 414 may include various shapes and have various sizes. As shown in FIG. 4A, the surface feature 414 may include a diamond embossed pattern. In some embodiments, each diamond in the diamond embossed pattern may be around 0.12 inches by around 0.07 inches. Other shapes and sizes of the surface feature 414 are possible.

Figure 5:
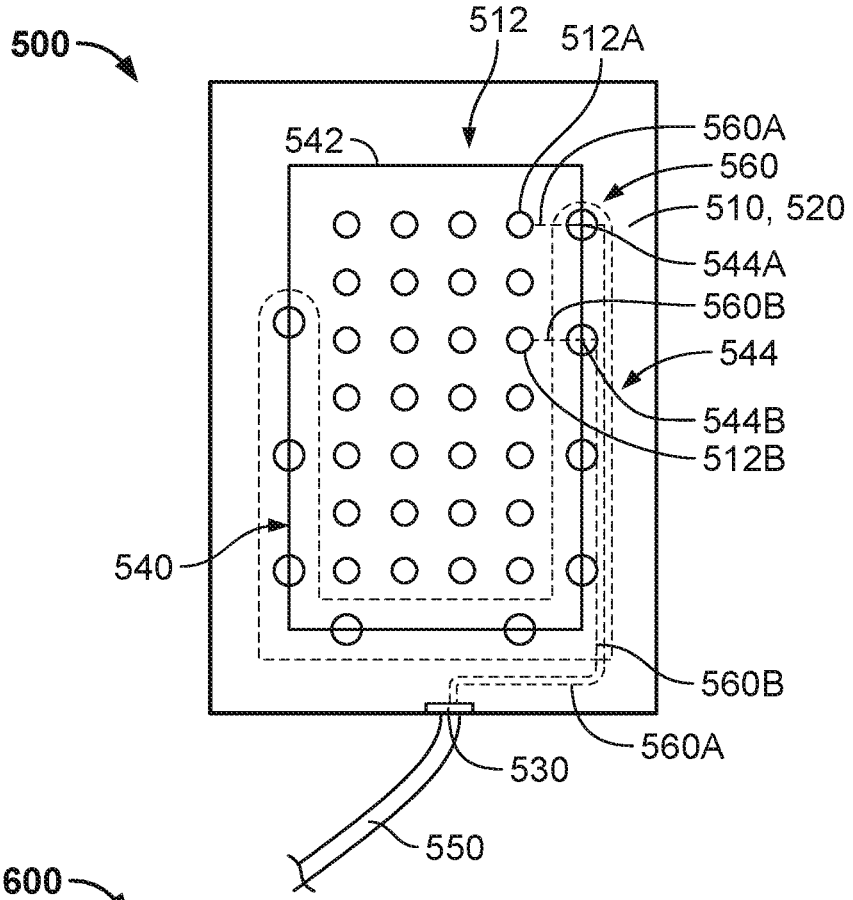
FIG. 5 shows aspects of an apparatus, according to an example embodiment.

The pattern of apparatus described herein may take various forms. For example, the pattern may include a perimeter with one or more openings. FIG. 5 shows aspects of an apparatus 500, according to an example embodiment. The apparatus 500 may include a pattern 540 defined on a top layer 510 and a bottom layer 520. The top layer 510 may include a plurality of inlets 512. Further, the apparatus 500 may include an outlet 530 disposed between the top layer 510 and the bottom layer 520. The outlet 530 may be coupled to a tube 550. The tube 550 in turn may be coupled to a suction source (not shown). The apparatus 500 may include other components as well, including one or more surface features as described above with respect to apparatus 200 and 300.

The pattern 540 may include a perimeter 542 disposed around the plurality of inlets 512 and one or more openings 544. The perimeter 542 and the one or more openings 544 may define a plurality of suction paths 560 for the plurality of inlets 512 to the outlet 530. In some embodiments, the perimeter 542 and one opening of the one or more openings 544 may define a suction path for each inlet of the plurality of inlets. In the illustrated example, the perimeter 542 and opening 544A may define suction path 560A for inlet 512A. Further, the perimeter 542 and opening 544B may define suction path 560B for inlet 512B. When the suction source applies suction to the apparatus 500, fluid may flow from inlet 512A along suction path 560A to outlet 530, and fluid may flow from inlet 512B along suction path 560B to outlet 530. The plurality of suction paths 560 may improve control (or predictability) of flow of fluid through the apparatus 500.

In some embodiments, the pattern 540 may be defined on the top layer 510 and the bottom layer 520 by sealing the top layer 510 and the bottom layer 520. For example, the pattern 540 may be defined on the top layer 510 and the bottom layer 520 by sealing one or more portions of the top layer 510 and one or more corresponding portions of the bottom layer 520 together. Further, in some embodiments, the pattern 540 may be defined on the top layer 510 and the bottom layer 520 by pressing the pattern 540 on the top layer 510 and the bottom layer 520. For example, the pattern 540 may be defined on the top layer 510 and the bottom layer 520 by pressing one or more portions of the top layer 510 and one or more corresponding portions of the bottom layer 520 together. The pattern 540 may be defined on the top layer 510 and the bottom layer 520 before, after, or during the sealing of one or more edges of the top layer 510 to one or more corresponding edges of the bottom layer 520.

Figure 6:
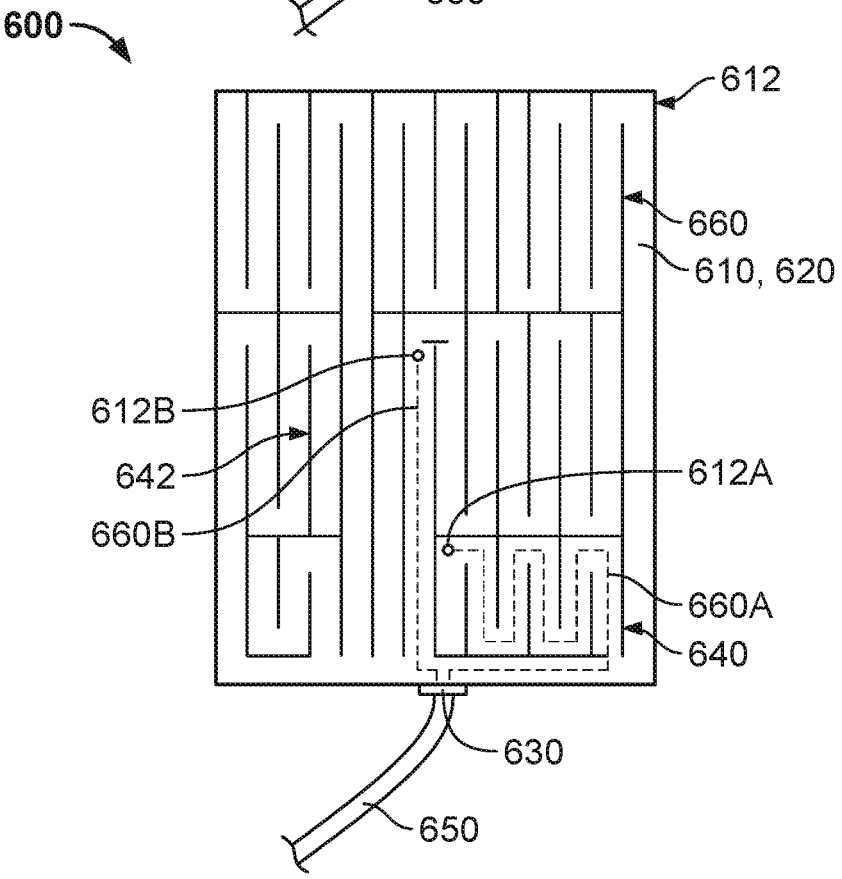
FIG. 6 shows aspects of an apparatus, according to an example embodiment.

As another example, the pattern may include a grid. FIG. 6 shows aspects of an apparatus 600, according to an example embodiment. The apparatus 600 may include a pattern 640 defined on a top layer 610 and a bottom layer 620. The top layer 610 may include a plurality of inlets 612. In the illustrated example, the plurality of inlets 612 may include two inlets, inlet 612A and inlet 612B. Further, the apparatus 600 may include an outlet 630 disposed between the top layer 610 and the bottom layer 620. The outlet 630 may be coupled to a tube 650. The tube 650 in turn may be coupled to a suction source (not shown). The apparatus 600 may include other components as well, including one or more surface features as described above with respect to apparatus 200 and 300.

The pattern 640 may include a grid 642 and the grid 642 may define a plurality of suction paths 660 for the plurality of inlets 612. In some embodiments, the grid 642 may define a suction path for each inlet of the plurality of inlets 612 to the outlet 630. In the illustrated example, the grid 642 may define a suction path 660A for inlet 612A. Further, the grid 642 may define a suction path 660B for inlet 612B. When the suction source applies suction to the apparatus 600, fluid may flow from inlet 612A along suction path 660A to outlet 630, and fluid may flow from inlet 612B along suction path 660B to outlet 630. The plurality of suction paths 660 may improve control flow of fluid through the apparatus 600.

As shown in FIG. 6, the inlet 612A may be located closer to the outlet 630 than the inlet 612B, and the suction path 660A may be longer than the suction 660B, In some embodiments, the suction paths of the plurality of suction paths 660 may have substantially equal lengths. Flow of fluid through the apparatus 600 may be improved when the suction paths from each inlet of the plurality of inlets 612 to the outlet 630 have substantially equal lengths. The term "substantially equal," as used in this disclosure, refers to exactly equal or one or more deviation from exactly equal that do not significantly change flow of fluid through apparatus described herein (e.g., less than or equal to a 25% change in volumetric flow rate of fluid). In some embodiments, the pattern 640 may be defined on the top layer 610 and the bottom layer 620 in the same or similar way as the pattern 540 is defined on the top layer 510 and the bottom layer 520.

Further, example apparatus may include a tube coupled to the outlet and disposed around the plurality of inlets. The tube may improve distribution suction across the apparatus. FIG. 7 shows aspects of an apparatus 700, according to an example embodiment. The apparatus 700 may include a top layer 710, a bottom layer 720, and an outlet 730. The top layer 710 may be disposed over the bottom layer. Further, the top layer 710 may include a plurality of inlets 712. The outlet 730 may be coupled to a tube 750. The tube 750 in turn may be coupled to a suction source (not shown). The apparatus 700 may include other components as well, including one or more surface features and a pattern as described above with respect to apparatus 200, 300, 500, and 600.

The apparatus 700 may include a second tube 770 coupled to the outlet 730. The second tube 770 may be disposed around the plurality of inlets 712. Additionally or alternatively, the second tube 770 may be disposed around a pattern. As shown in FIG. 7A, the second tube 770 may include a plurality of perforations 772, The plurality of perforations 772 may distribute suction across the apparatus 700, which may improve flow of fluid in the apparatus 700.

In the illustrated example, the second tube 770 may extend around the plurality of inlets 712. In such embodiments, the second tube 770 may have a length of around 20 feet. Other lengths of the second tube 770 are possible as well. However, in other embodiments, the second tube 770 may only extend around some of the plurality of inlets 712. Further, in some embodiments, edges of the top layer 710 may be sealed to corresponding edges of the bottom layer 720, and the second tube 770 may be disposed between the top layer 710 and the bottom layer 720.

Moreover, example apparatus may include a support. The support may hold the apparatus in place during operation. FIG. 8 shows aspects of an apparatus 800, according to an example embodiment. The apparatus 800 may include a bottom layer 820 and a support 880 attached to the bottom layer 820. In the illustrated example, the support 880 may include two-way adhesive tape 804A-D attached to the corners of the bottom layer 820. Other supports for apparatus 800 are possible as well.

Figure 9:
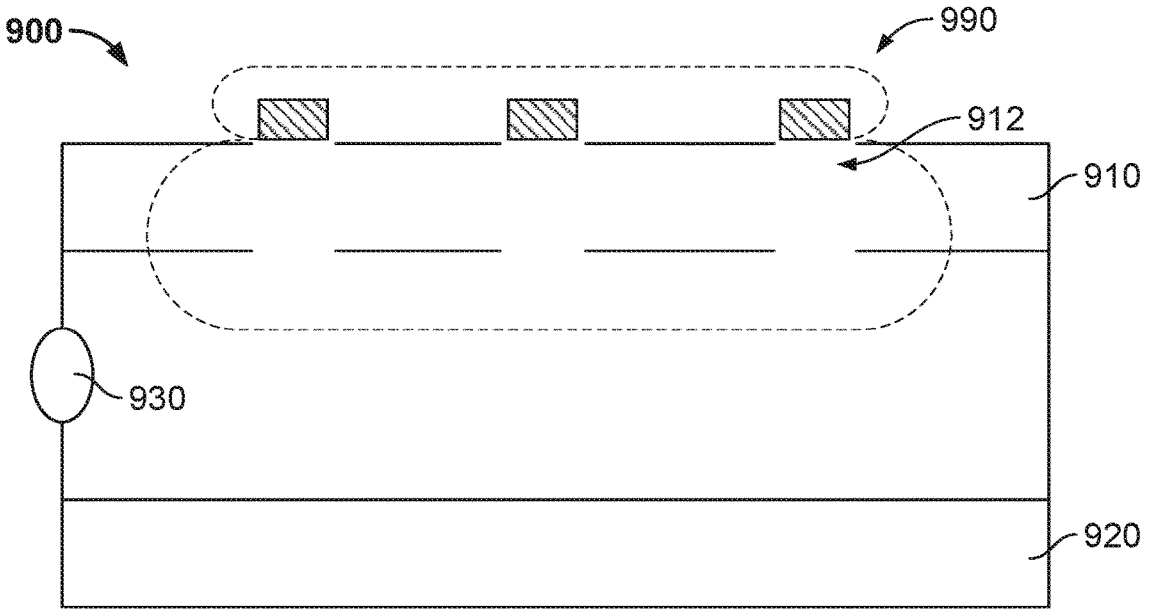
FIG. 9 shows aspects of an apparatus, according to an example embodiment.

In addition, example apparatus may include dissolvable barriers disposed over the plurality of inlets. FIG. 9 shows aspects of an apparatus 900, according to an example embodiment. The apparatus 900 may include a top layer 910, a bottom layer 920, and an outlet 930 disposed between the top layer 910 and the bottom layer 920. The top layer 910 may include a plurality of inlets 912. The outlet 930 may be coupled to a suction source (not shown). The apparatus 900 may include other components as well, including one or more surface features and a pattern as described above with respect to apparatus 200, 300, 500, and 600.

Further, the apparatus 900 may include a plurality of dissolvable barriers 990 disposed over the plurality of inlets 912 and the top layer 910. Each dissolvable barrier of the plurality of dissolvable barriers 990 may be disposed over a respective inlet of the plurality of inlets 912. Each dissolvable barrier may be configured to reduce (or block) flow of gas (e.g., air) through the respective inlet that it is disposed over. Further, each dissolvable barrier of the plurality of dissolvable barriers 990 may be configured to dissolve when contacted by liquid (e.g., water and other fluids associated with medical procedures). When the suction source applies suction to the apparatus 900, dissolvable barriers of the plurality of dissolvable barriers 912 that have not dissolved may assist with maintaining suction (e.g., a vacuum) between the top layer 910 and the bottom layer 920. In some embodiments, at least one dissolvable barrier of the plurality of dissolvable barriers 990 may include a gas-impervious film.

Figure 10:
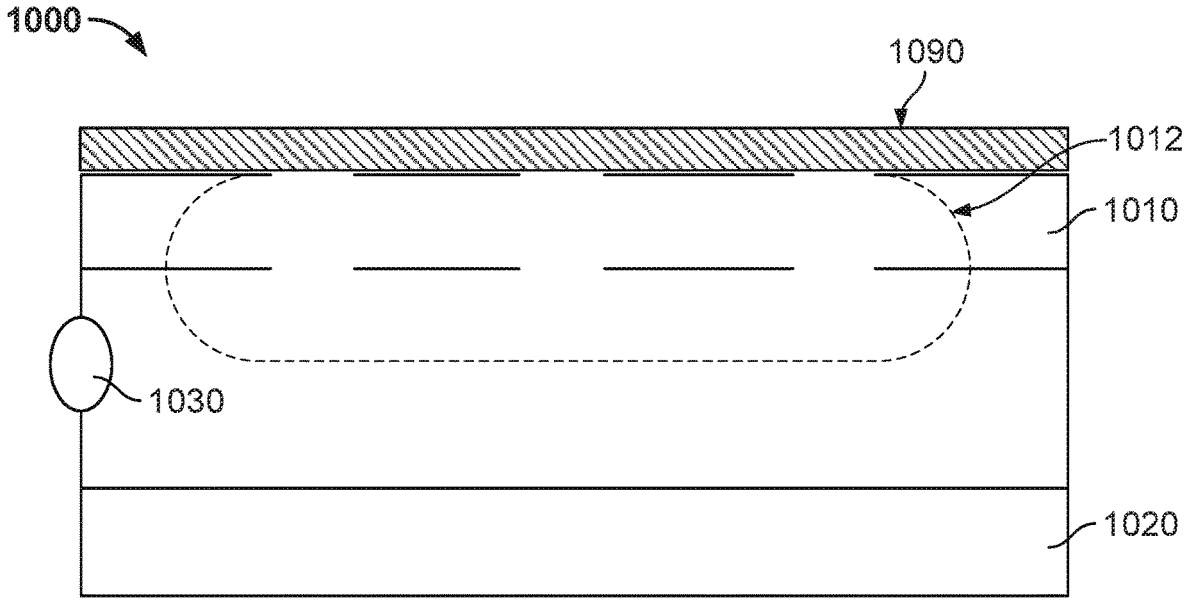
FIG. 10 shows aspects of an apparatus, according to an example embodiment.

Although apparatus 900 includes a plurality of dissolvable barriers 990, in other examples an apparatus may include a dissolvable barrier layer disposed over the plurality of inlets. FIG. 10 shows aspects of an apparatus 1000, according to an example embodiment. The apparatus 1000 may include a top layer 1010, a bottom layer 1020, and an outlet 1030 disposed between the top layer 1010 and the bottom layer 1020. The top layer 1010 may include a plurality of inlets 1012. The outlet 1030 may be coupled to a suction source (not shown). The apparatus 1000 may include other components as well, including one or more surface features and a pattern as described above with respect to apparatus 200, 300, 500, and 600.

Further, the apparatus 1000 may include a dissolvable barrier layer 1090 disposed over the plurality of inlets 1012 and the top layer 1010. The dissolvable barrier layer 1090 may include a plurality of portions and each portion (or some of the portions) may be disposed over a respective inlet of the plurality of inlets 1012. Each portion of the dissolvable barrier layer 1090 may be configured to reduce (or block) flow of gas. Further, each portion of the dissolvable barrier layer 1090 may be configured to dissolve when contacted by liquid. When the suction source applies suction to the apparatus 1000, portions of the dissolvable barrier layer that have not dissolved may assist with maintaining suction between the top layer 1010 and the bottom layer 1020. In some embodiments, the dissolvable barrier layer 1090 may include a gas-impervious film.

Figure 11:
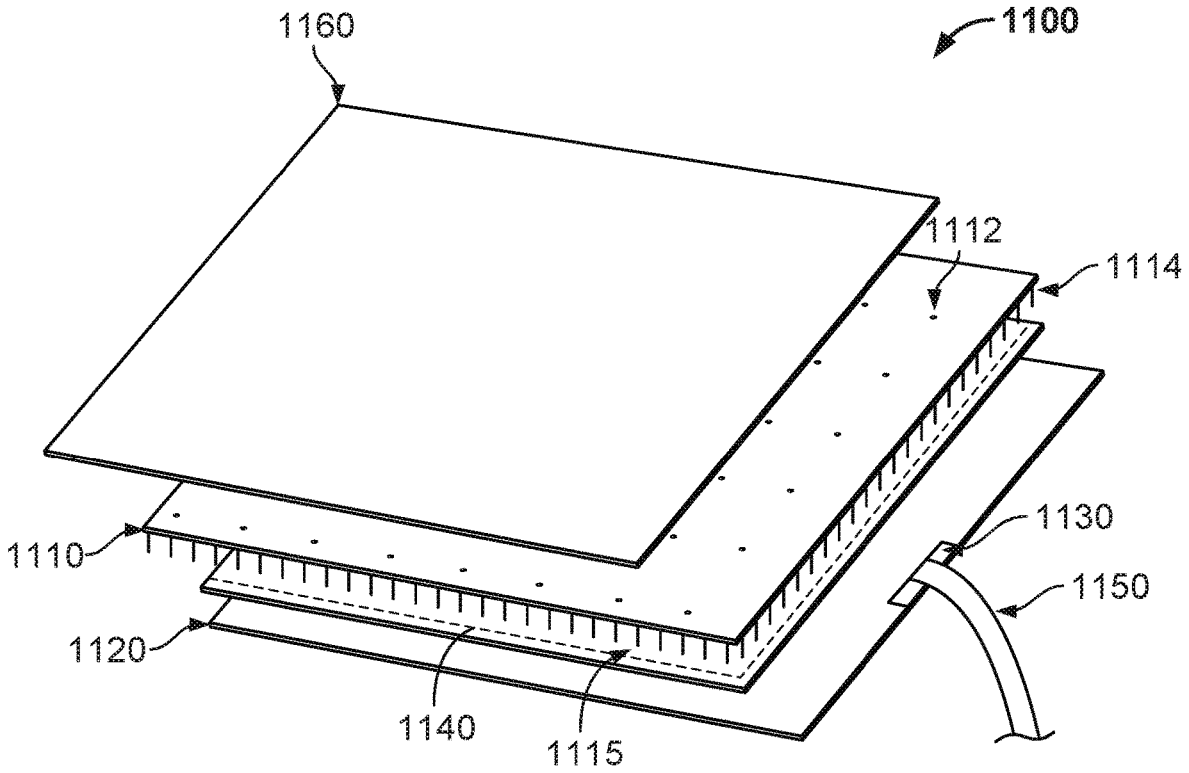
FIG. 11 shows an exploded view of an apparatus, according to an example embodiment.

Although example apparatus described above may include a pattern defined on at least one of the top layer and bottom layer, in other examples an apparatus may include an intermediate (third) layer disposed between the top layer and the bottom layer and the pattern may be defined on the intermediate layer. FIG. 11 shows an exploded view of an apparatus 1100, according to an example embodiment. The apparatus 100 may take the form of or be similar in form to the apparatus 1100. The apparatus 1100 may include a top layer 1110, a bottom layer 1120, an outlet 1130, and a cover layer 1160. The top layer 1110 may include a plurality of inlets 1112 and a surface feature 1114. The outlet 1130 may be disposed between the top layer 1110 and the bottom layer 1120, or alternatively disposed on the bottom layer 1120 or disposed on the top layer 1110. Further, the outlet 1130 may be coupled to a tube 1150, and the tube 1150 in turn may be coupled to a suction source (not shown).

The apparatus 1100 may be similar to apparatus 200, except that the apparatus 1100 may include an intermediate layer 1115 disposed between the top layer 1110 and the bottom layer 1120. In some embodiments, the intermediate layer 1115 may include a surface feature that opposes the top layer 1110 and/or a surface feature that opposes the bottom layer 1120. With this arrangement, the top layer 1110 might not include the surface feature 1114. Further, a pattern 1140 may be defined on the intermediate layer 1115. Similar to the pattern 240, the pattern 1140 may improve the distribution of suction across the apparatus 200. Further, similar to the pattern 240, the pattern 1140 may define a suction path from each inlet of the plurality of inlets 212 to the outlet 230. Via the pattern 1140, the suction source may apply the substantially same amount of suction to each inlet of the plurality of inlets 1112. The pattern 1140 may take the form of or be similar in form to the pattern 540 or the pattern 640.

Figure 12:
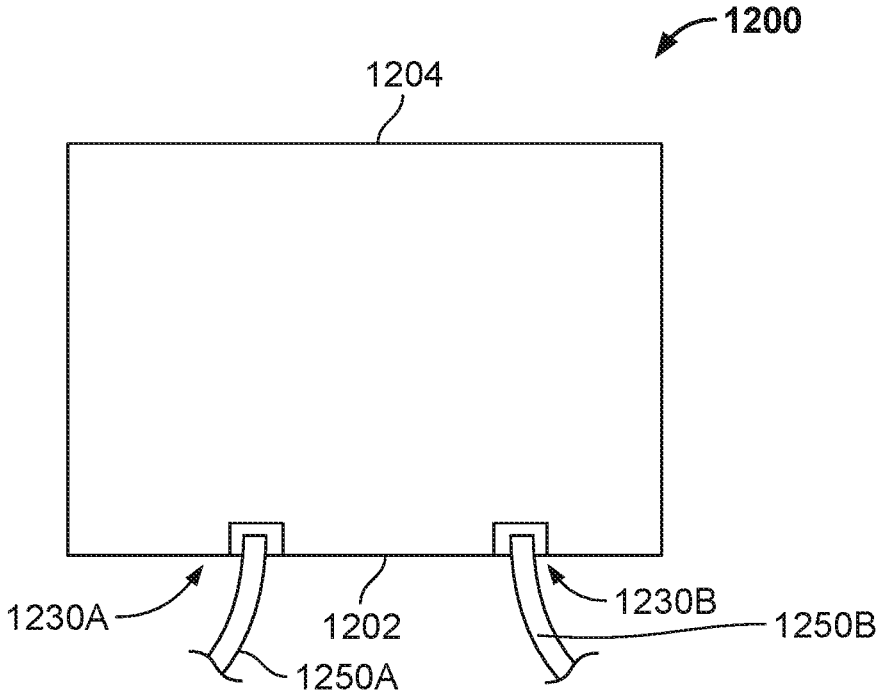
FIG. 12 shows aspects of an apparatus, according to an example embodiment.

Although example apparatus described above may include one outlet, in other examples, apparatus may include two or more outlets. The two or more outlets may improve flow of fluid through the apparatus. FIG. 12 shows aspects of an apparatus 1200, according to an example embodiment. The apparatus 1200 may include a first side 1202, a second side 1204, a first outlet 1230A, and a second outlet 1230B. The apparatus 1200 may include other components as well, including a top layer, a bottom layer, a plurality of inlets, one or more surface features, and a pattern as described above with respect to apparatus 200, 300, 500, and 600.

In the illustrated example, the first outlet 1230A and the second outlet 1230B may each be disposed on the first side 1202. Alternatively, the first outlet 1230A and the second outlet 1230B may each be disposed on the second side 1204. Further, the first outlet 1230A may be coupled to tube 1250A and the second outlet 1230B may be coupled to tube 1250B. In some embodiments, the tube 1250A and the tube 1250B may each be coupled to a suction source (not shown). Moreover, in some embodiments, the tube 1250A may be coupled to the suction source and the tube 1250B may be coupled to a second suction source (not shown). The second suction source may take the form of or be similar in form to the suction source.

Further, in some embodiments, the tube 1250A and the tube 1250B may each be coupled to a fitting (e.g., valve) disposed between the suction source and the apparatus 1200. Further still, in some embodiments, the first outlet 1230A and the second outlet 1230B may each be coupled to a fitting or a tube (e.g., the tube 770) disposed within the apparatus 1200. Moreover, in some embodiments, the first outlet 1230A may be coupled to the tube and the second outlet 1230B may be coupled to a second tube disposed within the apparatus 1200. The second tube may take the form of or be similar in form to the tube. Further, in some embodiments, the tube and the second tube may span different directions within the apparatus 1200.

In some embodiments, the apparatus 1200 may include a plurality of inlets similar in form to the plurality of inlets 212 and a pattern that is similar in form to the pattern 540 or the pattern 640. Further, in some embodiments, the pattern may define a suction path from each inlet to the plurality of inlets to the first outlet 1230A or the second outlet 1230B.

Figure 13:
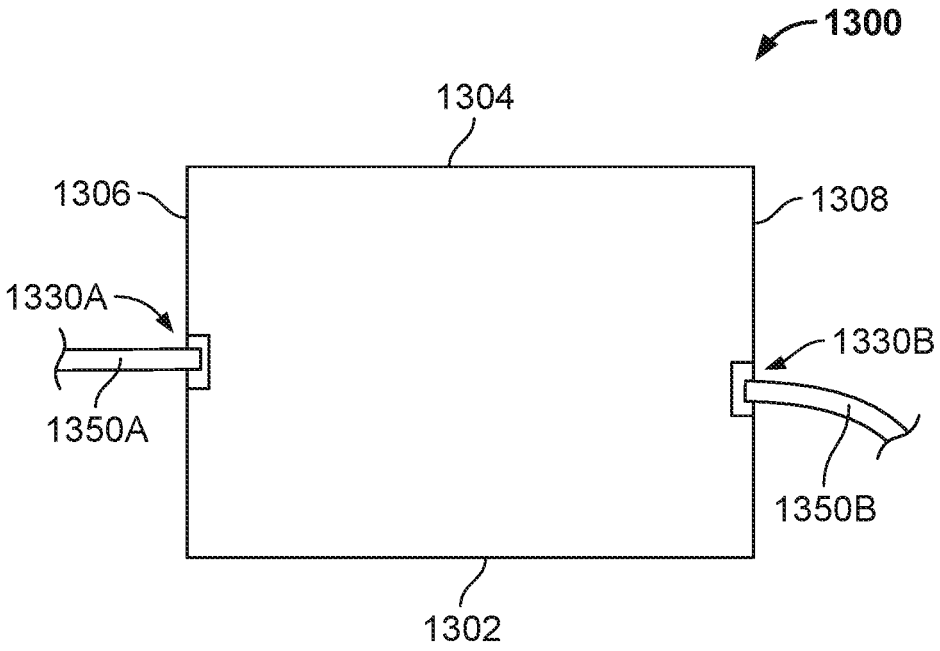
FIG. 13 shows aspects of an apparatus, according to an example embodiment.

In other examples, two or more outlets may be disposed on opposing sides of an apparatus. FIG. 13 shows aspects of an apparatus 1300, according to an example embodiment. The apparatus 1300 may include a first side 1302, a second side 1304, a third side 1306, and a fourth side 1308, a first outlet 1330A, and a second outlet 1330B. The apparatus 1300 may include other components as well, including a top layer, a bottom layer, a plurality of inlets, one or more surface features, and a pattern as described above with respect to apparatus 200, 300, 500, and 600.

In the illustrated example, the first outlet 1330A may be disposed on the third side 1306 and the second outlet 1330B may be disposed on the fourth side 1308. Alternatively, the first outlet 1330A may be disposed on the first side 1302 and the second outlet 1330B may be disposed to the second side 1304. Other arrangements of the first outlet 1330A and the second outlet 1330B on opposing sides of the apparatus 1300 are possible as well.

The first outlet 1330A may be coupled to tube 1350A. Further, the second outlet 1230B may be coupled to tube 1350B. The tubes 1350A and 1350B may be arranged in a similar way as the tubes 1250A and 1250B may be arranged. In some embodiments, the tube 1350A and the tube 1350B may each be coupled to a suction source (not shown). Moreover, in some embodiments, the tube 1350A may be coupled to the suction source and the tube 1350B may be coupled to a second suction source (not shown).

Further, in some embodiments, the tube 1350A and the tube 1350B may each be coupled to a fitting disposed between the suction source and the apparatus 1300. Further still, in some embodiments, the first outlet 1330A and the second outlet 1330B may each be coupled to a fitting or a tube disposed within the apparatus 1300. Moreover, in some embodiments, the first outlet 1330A may be coupled to the tube and the second outlet 1330B may be coupled to a second tube disposed within the apparatus 1300. Further, in some embodiments, the tube and the second tube may span different directions within the apparatus 1300.

In some embodiments, the apparatus 1300 may include a plurality of inlets similar in form to the plurality of inlets 212 and a pattern that is similar in form to the pattern 540 or the pattern 640. Further, in some embodiments, the pattern may define a suction path from each inlet to the plurality of inlets to the first outlet 1330A or the second outlet 1330B.

Although apparatus 1200 and 1300 include two outlets, in other examples apparatus may include more than two outlets, including three outlets or four outlets.

III. Example Methods

Figure 14:
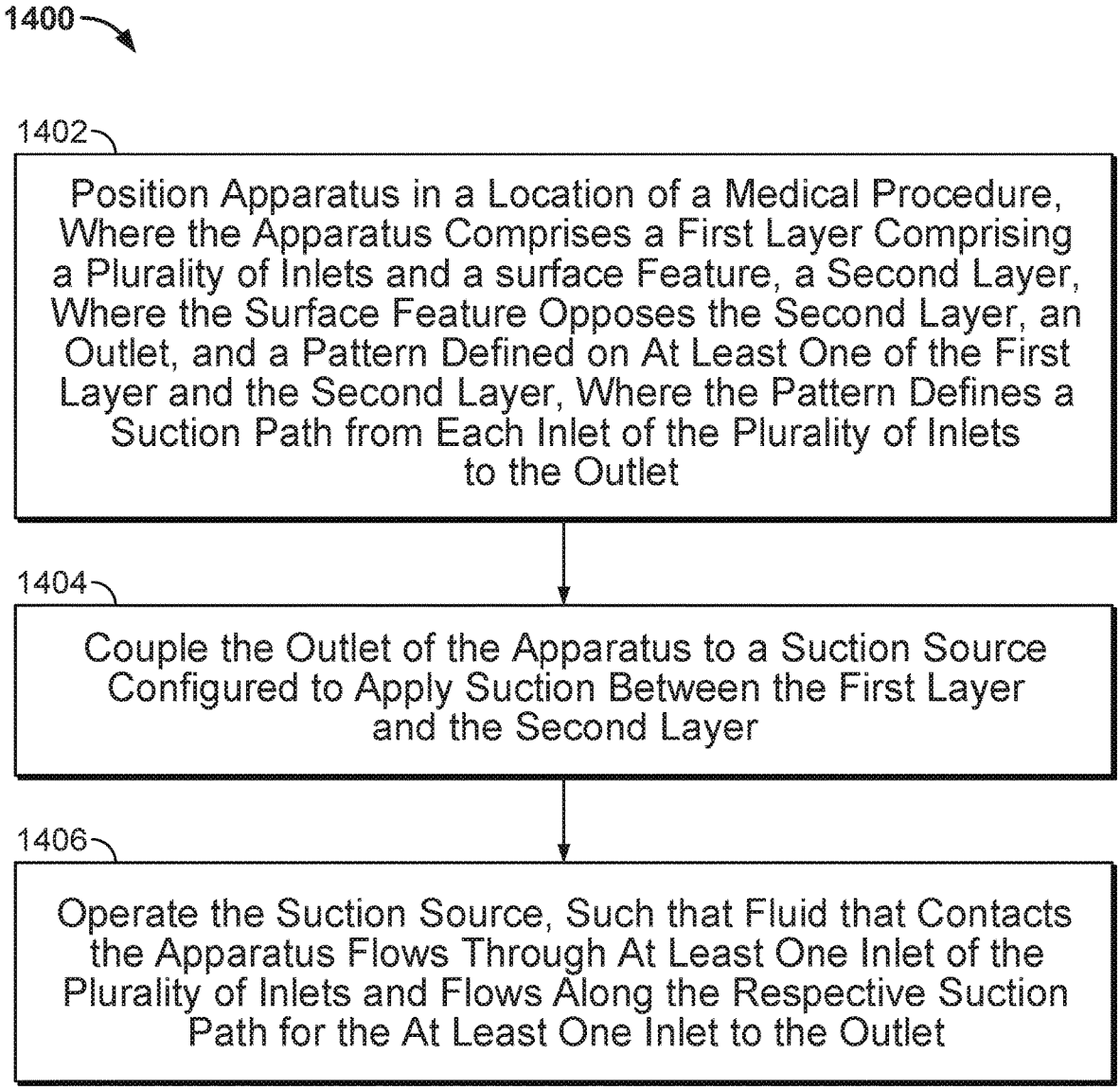
FIG. 14 shows a method, according to an example embodiment.

FIG. 14 depicts a method 1400, according to an example embodiment. Method 1400 begins at block 1402 with positioning an apparatus in a location of a medical procedure. In some embodiments, the location of a medical procedure may include a floor of an operating room where the medical procedure is or will be performed. The apparatus may include a first layer that includes a plurality of inlets and a surface feature, a second layer, wherein the surface feature opposes the second layer, an outlet, and a pattern defined on at least one of the first layer and the second layer, wherein the pattern defines a suction path from each inlet of the plurality of inlets to the outlet. The apparatus may take the form of or be similar in form to example apparatus described above with respect to FIGS. 1-13.

Method 1400 continues at block 1404 with coupling the outlet of the apparatus to a suction source configured to apply suction between the first layer and the second layer. In some embodiments, the suction source may be configured to pull a vacuum between the first layer and the second layer. The suction source may take the form of or be similar in form to example suction sources described above with respect to FIGS. 1-13.

Method 1400 continues at block 1406 with operating the suction source, such that fluid that contacts the apparatus flows through at least one inlet of the plurality of inlets and flows along the respective suction path for the at least one inlet to the outlet.

IV. Conclusion

Examples given above are merely illustrative and are not meant to be an exhaustive list of all possible embodiments, applications or modifications of the invention. Thus, various modifications and variations of the described methods and systems of the invention will be apparent to those skilled in the art without departing from the scope and spirit of the invention. Although the invention has been described in connection with specific embodiments, it should be understood that the invention as claimed should not be unduly limited to such specific embodiments. Indeed, various modifications of the described modes for carrying out the invention which are obvious to the skilled artisan.

It is understood that the invention is not limited to the particular methodology, protocols, etc., described herein, as these may vary as the skilled artisan will recognize. It is also to be understood that the terminology used herein is used for the purpose of describing particular embodiments only, and is not intended to limit the scope of the invention. It also is to be noted that, as used herein and in the appended claims, the singular forms "a," "an," and "the" include the plural reference unless the context clearly dictates otherwise. Thus, for example, a reference to "a structure" is a reference to one or more structures and equivalents thereof known to those skilled in the art.

Unless defined otherwise, all technical and scientific terms used herein have the same meanings as commonly understood by one of ordinary skill in the art to which the invention pertains. The embodiments of the invention and the various features and advantageous details thereof are explained more fully with reference to the non-limiting embodiments and/or illustrated in the accompanying drawings and detailed in the following description. It should be noted that the features illustrated in the drawings are not necessarily drawn to scale, and features of one embodiment may be employed with other embodiments as the skilled artisan would recognize, even if not explicitly stated herein.

Any numerical values recited herein include all values from the lower value to the upper value in increments of one unit provided that there is a separation of at least two units between any lower value and any higher value. As an example, if it is stated that the concentration of a component or value of a process variable such as, for example, size and the like, is, for example, from 1 to 90, specifically from 20 to 80, more specifically from 30 to 70, it is intended that values such as 1:5 to 85, 22 to 68, 43 to 51, 30 to 32, etc. are expressly enumerated in this specification. For values which are less than one, one unit is considered to be 0.0001, 0.001, 0.01 or 0.1 as appropriate. These are only examples of what is specifically intended and all possible combinations of numerical values between the lowest value and the highest value enumerated are to be considered to be expressly stated in this application in a similar manner.

Particular methods, devices, and materials are described, although any methods and materials similar or equivalent to those described herein can be used in the practice or testing of the invention.

What is claimed is:

1. An apparatus comprising:

a first layer comprising a plurality of inlets and a surface feature;

a second layer, wherein the surface feature opposes the second layer;

an outlet; and a pattern defined on at least one of the first layer and the second layer, wherein the pattern defines a suction path from each inlet of the plurality of inlets to the outlet, and wherein the suction paths from each inlet of the plurality of inlets to the outlet have substantially equal lengths.

2. The apparatus of claim 1, wherein the pattern comprises a grid, and wherein the grid defines the suction path from each inlet of the plurality of inlets to the outlet.

3. The apparatus of claim 1, wherein the surface feature is molded on the first layer.

4. The apparatus of claim 1, wherein the second layer comprises a second surface feature, and wherein the second surface feature contacts the surface feature of the first layer.

5. The apparatus of claim 1, wherein the pattern is defined on the first layer and the second layer by sealing the first layer and the second layer.

6. The apparatus of claim 1, wherein the pattern is defined on the first layer and the second layer by pressing the pattern on the first layer and the second layer.

7. The apparatus of claim 1, wherein at least one of the first layer and the second layer comprises a surfactant that reduces surface tension of fluid.

8. The apparatus of claim 1, further comprising a cover layer disposed over the first layer, wherein the cover layer is configured to distribute fluid to two or more inlets of the plurality of inlets.

9. The apparatus of claim 1, wherein at least one inlet of the plurality of inlets comprises a perforation in the first layer.

10. The apparatus of claim 1, wherein the plurality of inlets has an area that is greater than an area of the outlet.

11. The apparatus of claim 1 further comprising a tube coupled to the outlet, wherein the tube is disposed around the plurality of inlets, and wherein the tube comprises a plurality of perforations through a surface of the tube.

12. The apparatus of claim 1, wherein the outlet is configured to be coupled to a suction source for applying suction between the first and second layers.

13. The apparatus of claim 1 further comprising a plurality of dissolvable barriers disposed over the plurality of inlets.

14. The apparatus of claim 13, wherein at least one dissolvable barrier of the plurality of dissolvable barriers comprises a gas-impervious film.

15. The apparatus of claim 13, wherein each dissolvable barrier of the plurality of dissolvable barriers is configured to dissolve when contacted by liquid.

16. The apparatus of claim 1 further comprising a dissolvable barrier layer disposed over the plurality of inlets and the first layer, wherein the dissolvable barrier layer comprises a plurality of portions, wherein each portion of the plurality of portions is disposed over a respective inlet of the plurality of inlets.

17. A method comprising:

positioning an apparatus in a location of a medical procedure, wherein the apparatus comprises:

a first layer comprising a plurality of inlets and a surface feature, a second layer, wherein the surface feature opposes the second layer, an outlet, and a pattern defined on at least one of the first layer and the second layer, wherein the pattern defines a suction path from each inlet of the plurality of inlets to the outlet, and wherein the suction paths from each inlet of the plurality of inlets to the outlet have substantially equal lengths;

coupling the outlet of the apparatus to a suction source configured to apply suction between the first layer and the second layer; and operating the suction source, such that fluid that contacts the apparatus flows through at least one inlet of the plurality of inlets and flows along the respective suction path for the at least one inlet to the outlet.

* * * * *